United States Patent [19]

Ushirogata

[11] Patent Number: 4,762,312

[45] Date of Patent: Aug. 9, 1988

[54] SORTER WITH A FUNCTION OF BINDING COPY SHEETS

[75] Inventor: Yoshiaki Ushirogata, Tokyo, Japan

[73] Assignee: Ricoh Company, Ltd., Tokyo, Japan

[21] Appl. No.: 38,031

[22] Filed: Apr. 14, 1987

[30] Foreign Application Priority Data

Apr. 15, 1986 [JP] Japan ..... 61-86706
Jun. 23, 1986 [JP] Japan ..... 61-94542[U]

[51] Int. Cl.[4] ..... B42B 1/02
[52] U.S. Cl. ..... 270/53; 227/8; 227/50
[58] Field of Search ..... 270/53, 37; 227/2, 7–8, 227/20, 48, 50, 108, 120; 355/3 SH, 14 SH

[56] References Cited

U.S. PATENT DOCUMENTS 4,523,750 6/1985 Hubler ..... 227/2 X
4,549,804 10/1985 Braun et al. ..... 355/14 SH
4,566,782 1/1986 Britt et al. ..... 270/53
4,681,310 7/1987 Cooper ..... 270/53

*Primary Examiner*—Eugene H. Eickholt
*Attorney, Agent, or Firm*—Cooper & Dunham

[57] ABSTRACT

A sorter for use with a copier and others and having a function of binding a stack of copy sheets. The sorter includes a single stapler which is shared by all bins of the sorter, and a single bin drive unit adapted to move any of the bins loaded with copy sheets to a prescribed position where the stapler is to drive a staple. The stapler and the bin drive unit are moved in an interlocked motion to positions which correspond to the respective bins, thereby sequentially binding copy sheets which are stacked in the bins.

5 Claims, 10 Drawing Sheets

130
132
134
136
138
22
36
110
74
CPU
RAM
CONTROL CIRCUIT
TIMER
MOTOR
MOTOR
MOTOR
SOLENOID
SOLENOID
SOLENOID
SOLENOID
SOLENOID
SOLENOID
SOLENOID
SHEED END SENSOR
COPY SHEET DISCHARGE SENSOR
END-OF-STAPLING SENSOR
BIN MOVEMENT SENSOR
BIN RETURN SENSOR
112a, 112b
23a, 23b
55
51a, 51b
53a, 53b

SORTER WITH A FUNCTION OF BINDING COPY SHEETS

BACKGROUND OF THE INVENTION

The present invention relates to a sorter for use with a copier and others and, more particularly, to a sorter which is furnished with a capability of binding a stack of copy sheets.

A sorter for use with a copier or the like includes multiple bins which are arranged one after another in the vertical direction, and serves to stack paginated copy sheets in each of the bins. Sorters heretofore proposed include a one having a capability of binding a stack of copy sheets. Specifically, in such a sorter, copy sheets sequentially delivered to any of the bins are shifted one by one toward one side edge of the bin by a shift roller which is movable toward and away from copy sheets, then the bin loaded with the copy sheets is moved to a prescribed stapling position, and then a staple is driven into the copy sheets to bind them together.

A problem with a sorter having a binding function as stated above is that should each bin be provided with various mechanical arrangements for implementing the binding function, e.g., a mechanism for actuating the roller, a bin driving device for moving the bin and a stapler for driving staples, the sorter would become prohibitively complicated in construction and expensive.

Another problem is that should any of copy sheets in a stack have a curl in the vicinity of its binding area, simply stapling that stack would cause it to be bound with the copy sheets not neatly aligned.

SUMMARY OF THE INVENTION

It is therefore an object of the present invention to provide a simple and inexpensive sorter having a copy sheet binding function.

It is another object of the present invention to provide a sorter having a copy sheet binding function which enhances the accuracy of stapling operation.

It is another object of the present invention to provide a sorter having a copy sheet binding function which allows a stack of copy sheets to be bound in accurate alignment even if any of the sheets is curled.

It is another object of the present invention to provide a generally improved sorter having a copy sheet binding function.

A sorter having a function of binding copy sheets of the present invention comprises a plurality of bins each for stacking copy sheets therein, a stapler for driving a staple into a predetermined portion of a stack of copy sheets in any of the bins, bin moving means for moving the bin loaded with a stack of copy sheets toward the stapler so that the predetermined portion of the stack is brought to a predetermined stapling position, and drive transmitting means for moving the stapler and the bin moving means in an interlocked motion to, respectively, a position corresponding to a selected one of the bins and a drive position for driving the selected bin toward the stapler.

In accordance with the present invention, a sorter for use with a copier and others and having a function of binding a stack of copy sheets includes a single stapler which is shared by all bins of the sorter, and a single bin drive unit adapted to move any of the bins loaded with copy sheets to a prescribed position where the stapler is to drive a staple. The stapler and the bin drive unit are moved in an interlocked motion to positions which correspond to the respective bins, thereby sequentially binding copy sheets which are stacked in the bins.

The above and other objects, features and advantages of the present invention will become more apparent from the following detailed description taken with the accompanying drawings.

DESCRIPTION OF THE PREFERRED EMBODIMENTS

Figure 1:
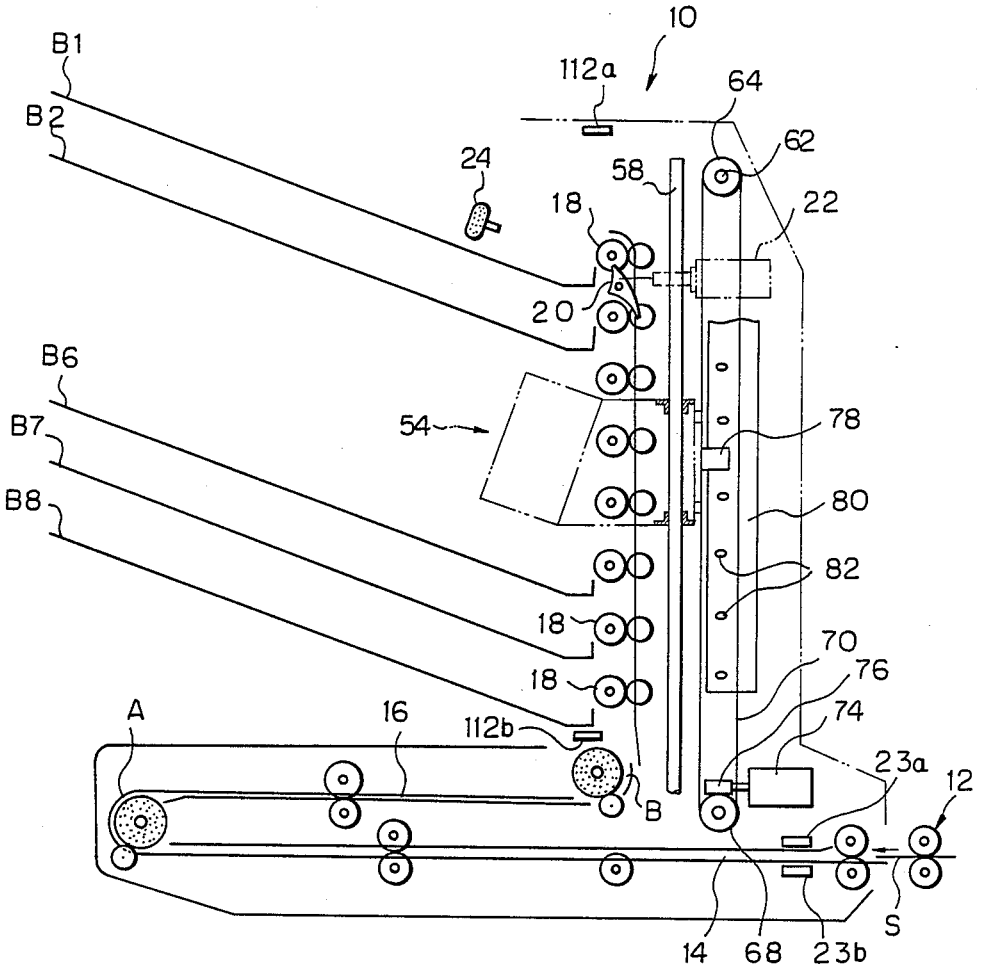
FIG. 1 is a schematic view of a sorter embodying the present invention.

Referring to FIG. 1 of the drawings, a sorter with a copy sheet binding function in accordance with the present invention is shown and generally designated by the reference numeral 10. As shown, a copy sheet S of the first page which is discharged by a pair of discharge rollers 12 from a copier is transported through a transport path 14 of the sorter 10. At a position A of the transport path 14, the copy sheet S is turned over to be fed through another transport path 16 to the right, as viewed in FIG. 1. As the copy sheet S reaches a position B in the transport path 16, it is turned by 90 degrees to advance toward delivery roller pairs 18 which are positioned one after another in the vertical direction. Each delivery roller pair 18 is provided with a deflecting pawl 20 the position of which is controlled by a solenoid 22. The copy sheet S is delivered to a selected one of a series of bins B1 to B8 (bins B3 to B5 are not shown) or, for example, to the first bin B1 by the pawl 20. If other copy sheets of the subsequent pages follow the copy sheet S, they are sequentially stacked one upon another in the particular bin, the first bin B1 in this case. After a set of copy sheets have been stacked in the first bin B1, another set of copy sheets are stacked in the second bin B2 by the same procedure. Such a sequence of steps are repeated thereafter. Sensor elements 23*a* and 23*b* are disposed in the previously stated transport path 14 to sense the copy sheet S in cooperation as the latter is transferred from the copier to the sorter 10. Each copy sheet S is sequentially brought to one prescribed side within the sorter 10 as it is transported in the sorter 10. Further, the copy sheet S is brought to one prescribed side in the bin to which it is distributed, by a shift roller 24.

Means for moving the bins and other various arrangements will be described, taking the first bin B1 for example.

Figure 2:
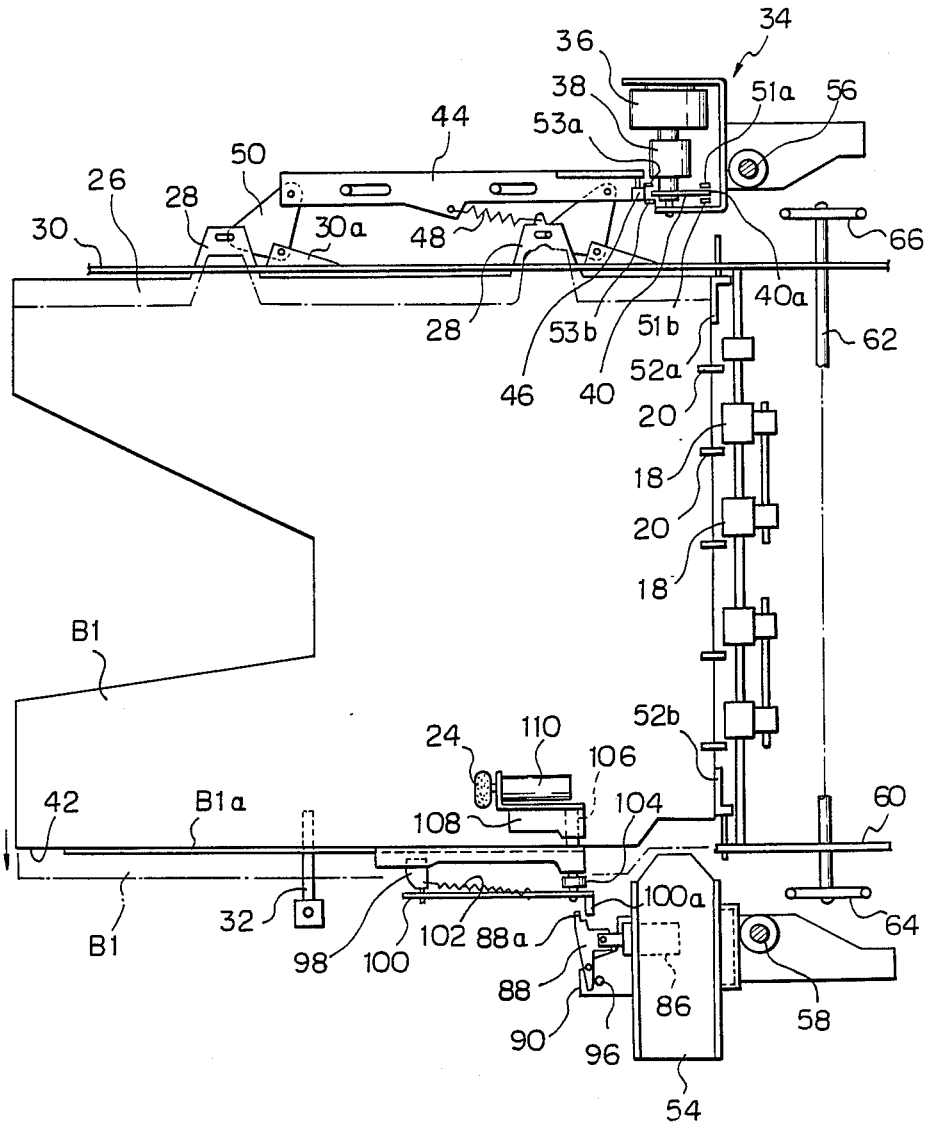
FIG. 2 is a plan view of a bin, a bin drive unit, and others which are included in the sorter of FIG. 1.
Figure 3:
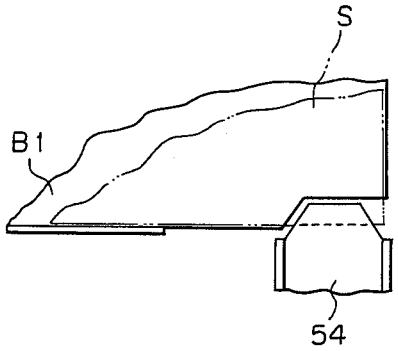
FIG. 3 is a diagram showing a relationship between a copy sheet and a stapler which is to bind the copy sheet together with the others.

Referring to FIG. 2, there is shown the bin B1 and the constructions of a bin drive unit and others in a plan view. A lug 28 extends from one side edge 26 of the bin B1 and protrudes to the outside through a perforation of a side wall 30 of the sorter 10. A bin guide pin 32 supports the bottom of the bin B1 to promote smooth movement of the bin B1. The bin drive unit 34 includes a motor 36, a ½ rotation clutch 38, and a disk-shaped eccentric cam 40 having a larger diameter portion and a smaller diameter portion. The ½ rotation clutch 38 serves to transmit only half a rotation of the motor 36. As the copy sheets S are distributed to the bin B one by one, they are brought one by one to one side edge 42 of the bin B1 by the shift roller 24.

When a set of copy sheets are shifted or gathered in one direction on the bin B1 as described above and fully stacked on the bin B1, the motor 36 is energized so that the eccentric cam 40 is rotated by half a rotation through the ½ rotation clutch 38. The cam 40 in turn urges a cam follower 46, which is provided on an actuating lever 44, with its larger diameter portion 40*a* resulting that the lever 44 is moved to the left in FIG. 2 against the action of a spring 48. The actuating lever 44, the lug 28 of the bin B1 and a lug 30*a* of the sorter side wall 30 are interconnected by a link plate 50. Hence, as the actuating lever 44 is moved to the left as stated, the bin B1 is shifted to a position indicated by dash-and-dot lines through the link plate 50. This movement of the bin B1 is sensed by cooperative sensor elements 51*a* and 51*b*. The bin B1 being moved so is prevented from skewing by pin guides 52*a* and 52*b*.

In the dash-and-dot line position of the bin B1, a corner portion of the copy sheets S on the bin B1 is aligned with a stapler 54 and stapled there to produce a bound volume of copy sheets S. A sensor 55 is associated with the stapler 54 to sense the completion of a stapling action of the stapler 54. On completion of the binding operation, the eccentric cam 40 is caused into another half rotation so that the actuating lever 44 is returned by the spring 48 to its rightward position while, at the same time, the bin B1 is restored by the link plate 50 to its original position. This movement of the bin B1 is sensed by the sensor 53*a*, 53*b*. Such a sequence of steps are applied also to the second bin B2 and onward so as to bind a stack of copy sheets in each of them. In an alternative arrangement, the bin may be driven directly by the eccentric cam 40 of the bin drive unit 34 without the intermediary of the lever 44 and link plate 50.

Figure 4:
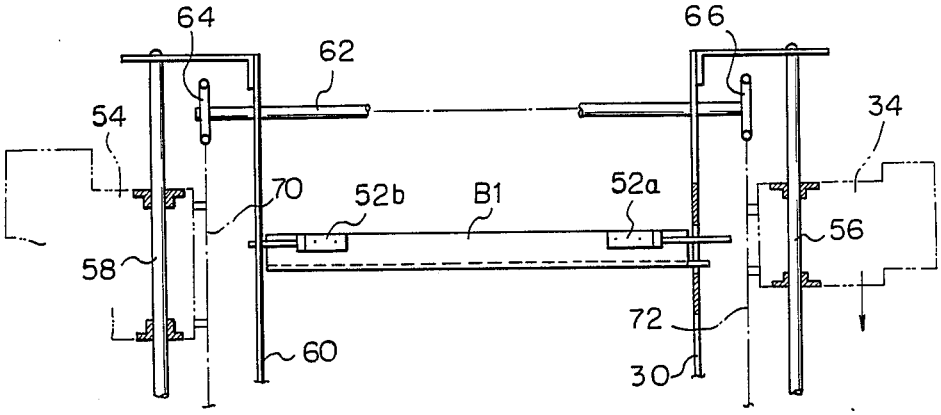
FIG. 4 is a view of an arrangement for supporting the bin drive unit and the stapler in a vertically movable manner.

As shown in FIG. 4, the bin drive unit 34 and the stapler 54 are mounted on and movable up and down along upright guide shafts 56 and 58, respectively. A shaft 62 is rotatably supported by both side walls 30 and 60 of the sorter 10 while sprockets 64 and 66 are individually fixed on both ends of the shaft 62. A chain 70 is passed over the sprocket 64 and a sprocket 68, FIG. 1, which is located beneath the sprocket 64. Likewise, a chain 72 is passed over the sprocket 66 and a sprocket, not shown, which is located beneath the sprocket 66. The stapler 54 is connected to the chain 70, and the bin drive unit 34 to the chain 72.

A worm wheel, not shown, is rigidly mounted on a shaft of the sprocket 68. As shown in FIG. 1, a worm 76 which is rigid on an output shaft of a motor 74 is held in constant mesh with the warm wheel. When the motor 74 is rotated, the worm wheel meshed with the worm 76 is rotated slowly based on a prescribed gear reduction ratio. This causes the sprocket 68 to rotate slowly to drive the chain 70 upward or downward. Simultaneously, the other chain 72 is driven through the shaft 62 and sprocket 66, FIG. 4, moving the bin drive unit 34 upward or downward.

In FIG. 1, the stapler 54 is usually held in alignment with the first or uppermost bin B1. After the stapler 54 has bound a stack of copy sheets in such a position, the motor 74 is energized to lower the stapler 54 into alignment with the second bin B2. In this manner, the stapler 54 is brought to a half in alignment with each of the bins by the intermittent rotation of the motor 74. As shown in FIG. 1 a position sensor 78 is connected to the chain 70 so as to cooperate with a plate 80 which is formed with openings 82, whereby each position where the stapler 54 should be stopped is defined. Specifically, the openings 82 of the plate 80 are provided in one-to-one correspondence with the bins. The bin drive unit 34, too, is brought to a halt in a position where it should drive a selected one of the bins, interlocked to the stapler 54.

The actuating lever 44, link plate 50 and others shown in FIG. 2 are associated with each of the bins. When the bin drive unit 34 is lowered by a predetermined distance, as indicated by an arrow in FIG. 4, the eccentric cam 40 of the unit 34 becomes aligned with the cam follower 46 of the actuating lever 44 which is associated with the next bin.

It will be seen from the above that, among the various members shown in FIGS. 1 and 4, the motor 74, worm 76, worm wheel, not shown, sprocket 68, chain 70, sprocket 64, shaft 62, sprocket 66, chain 72 and others constitute an exemplary drive transmission device for moving the bin drive unit 34 and the stapler 54 to, respectively, a position to drive a selected one of the bins and a position corresponding to that bin, while interlocking them to each other.

In FIG. 1, as the first copy sheet is received in the first bin B1, the collecting roller 24 is brought into contact with the copy sheet and forces it toward the side edge 42 of the bin B1, FIG. 2, due to friction caused by the rotation of the roller 24. This operation is repeated on a sheet-by-sheet basis.

Figure 5:
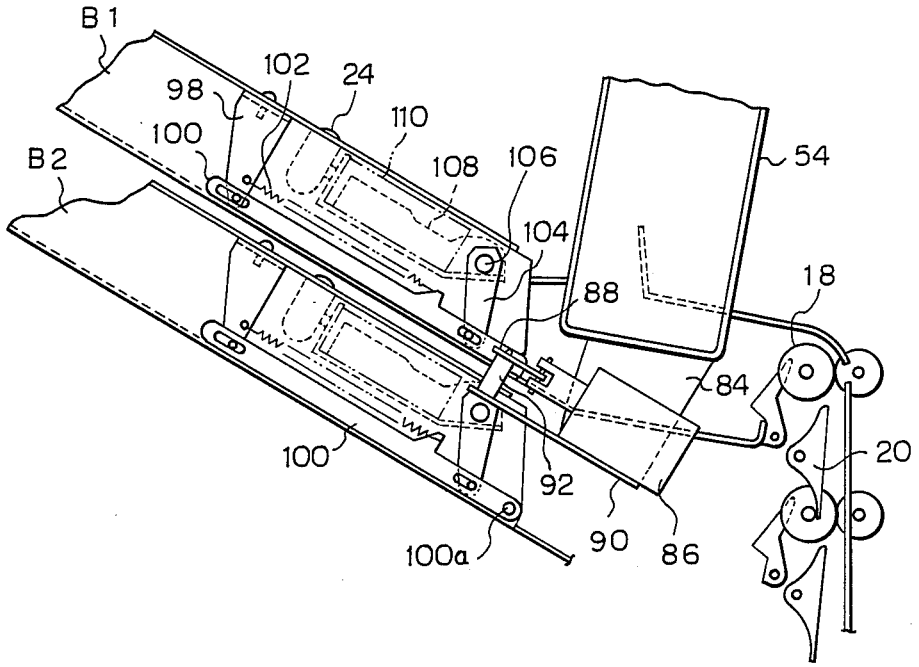
FIG. 5 is a view of a mechanism for driving a shift roller.

Referring to FIG. 5, a solenoid 86 is mounted on a stapler holder 84 which is adapted to hold the stapler 54. An actuating member 88 is connected to the solenoid 86, as also shown in FIG. 2. As shown in FIG. 5, the actuating member 88 is pivoted to a stepped shaft 92 which is studded on a mounting plate 90, and is constantly biased by a compression spring 94, FIG. 6, into engagement with a stop pin 96. As shown in FIGS. 2 and 5, a lever 100 is supported by a support plate 98 in such a manner as to be movable in its longitudinal direction. The lever 100 is maintained in the illustrated position by a tension spring 102 which is anchored at one end to the lever 100 and at the other end to the support plate 98. In this position of the lever 100, a pin 100*a* studded on the lever 100 faces a projection 88*a* of the actuating member 88. An arm 104 is connected at its free end to the lever 100 and at its base end to a shaft 106. A lever 108 is rigidly mounted on the shaft 106 while a motor 110 is mounted on the lever 108. The motor 110 is adapted to drive the shift roller 24.

In FIG. 1, when the first copy sheet S is fully received in the first bin B1 with its trailing end moved clear of the uppermost delivery roller pair 18, cooperative sensor elements 112*a* and 112*b* sense such an occurence and, in response to a detect output of the sensor 112*a*, 112*b*, the solenoid 86 of FIG. 2 is energized. Then, the solenoid 86 rotates the actuating member 88 clockwise about the stepped shaft 92, FIG. 6, so that the projection 88*a* of the member 88 urges the pin 100*a* to thereby force the lever 100 to the right. In FIG. 5, as the lever 100 is moved to the right, the arm 104 is rotated counterclockwise by a predetermined angle to in turn rotate the lever 108 in the same direction. This causes the shift roller 24 into contact with the copy sheet S which has been received in the bin B1. In FIG. 7, the copy sheet in the bin B1 is not shown for the sake of clarity.

The motor 110 begins to rotate in response to the sensor output stated above, causing the shift roller 24 to rotate. In this particular embodiment, therefore, the roller 24 is brought into contact with the copy sheet while being rotated. Alternatively, an arrangement may be made such that the shift roller 24 is rotated after being caused into contact with the copy sheet. In any case, the shift roller 24 slides the copy sheet S until a side edge of the latter abuts against a side wall B1*a* of the bin B1, FIG. 2, the roller 24 slipping itself on the copy sheet thereafter. Consequently, the copy sheet S is retained in a prescribed position for stapling.

Figure 6:
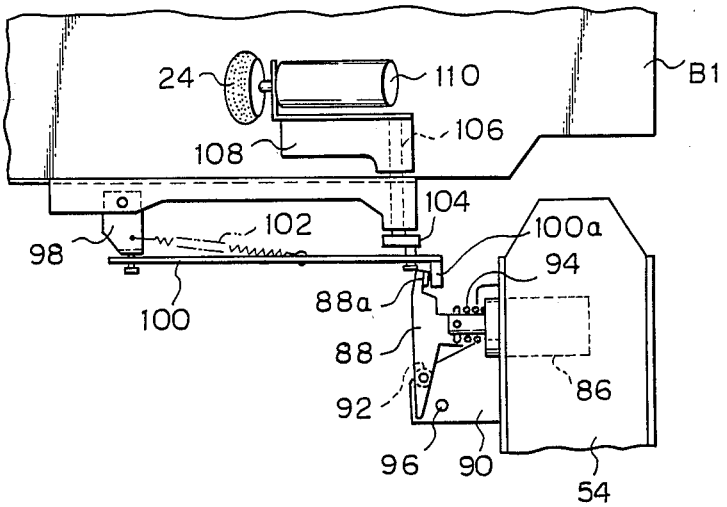
FIG. 6 is a view of the shift roller which is moved from the position of FIG. 2 to a position where it makes contact with a copy sheet.
Figure 7:
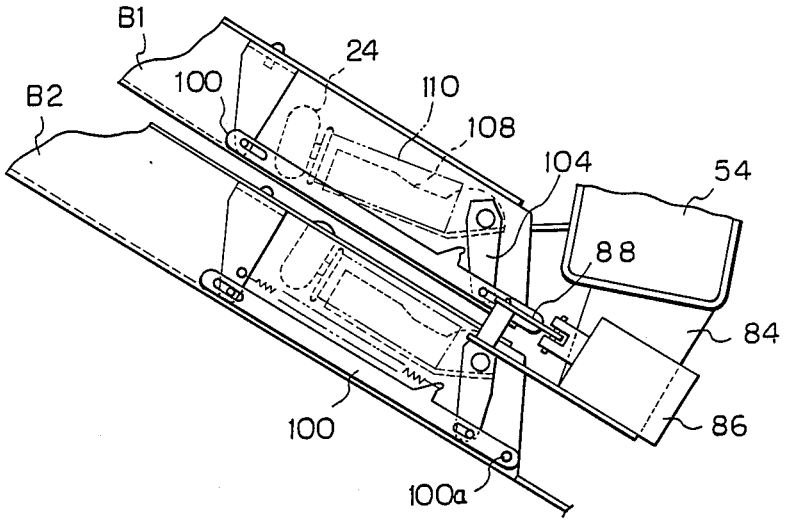
FIG. 7 is a view of the shift roller associated with the first bin which is moved from the position of FIG. 5 into contact with a copy sheet.

Thereafter, the solenoid 86 of FIG. 6 is deenergized to restore the actuating member 88 to the position of FIG. 2. Simultaneously, the movable lever 100, FIG. 7, is pulled by the spring 102, FIG. 6, to return to the position of FIG. 5. The arm 104 is rotated clockwise by the lever 100 which is in the above-stated movement. The lever 108, therefore, is moved in the same direction as the arm 104, whereby the shift roller 24 is restored to the position of FIG. 5 away from the copy sheet S. Such a procedure is repeated every time a copy sheet is distributed to the fist bin B1, thereby accurately aligning one side edge of a set of copy sheets. Then, the bin B1 is shifted toward the stapler 54 in order to bind the copy sheets.

On completion of the binding operation, the motor 74, FIG. 1, is rotated to lower the stapler 54 until the projection 88*a* of the actuating member 88 faces the pin 100*a*, FIG. 5, which is studded on the movable lever 100 of the second bin B2, FIG. 2. In this condition, copy sheets which are distributed to the second bin B2 are shifted one by one in the above-stated manner. The same sheet shifting procedure also applies to all the other bins.

It is to be noted that the solenoid 86 is only an example of drive means available for driving the actuating member 88 to bring the shift roller 24 into contact with a copy sheet, and it may be replaced with any other one insofar as it implements the driving function.

Referring to FIGS. 8, 9, 10A and 10B, another embodiment of the present invention is shown. In those figures, the same or similar structural elements as those shown in FIGS. 1 to 7 are designated by like reference numerals.

Figure 8:
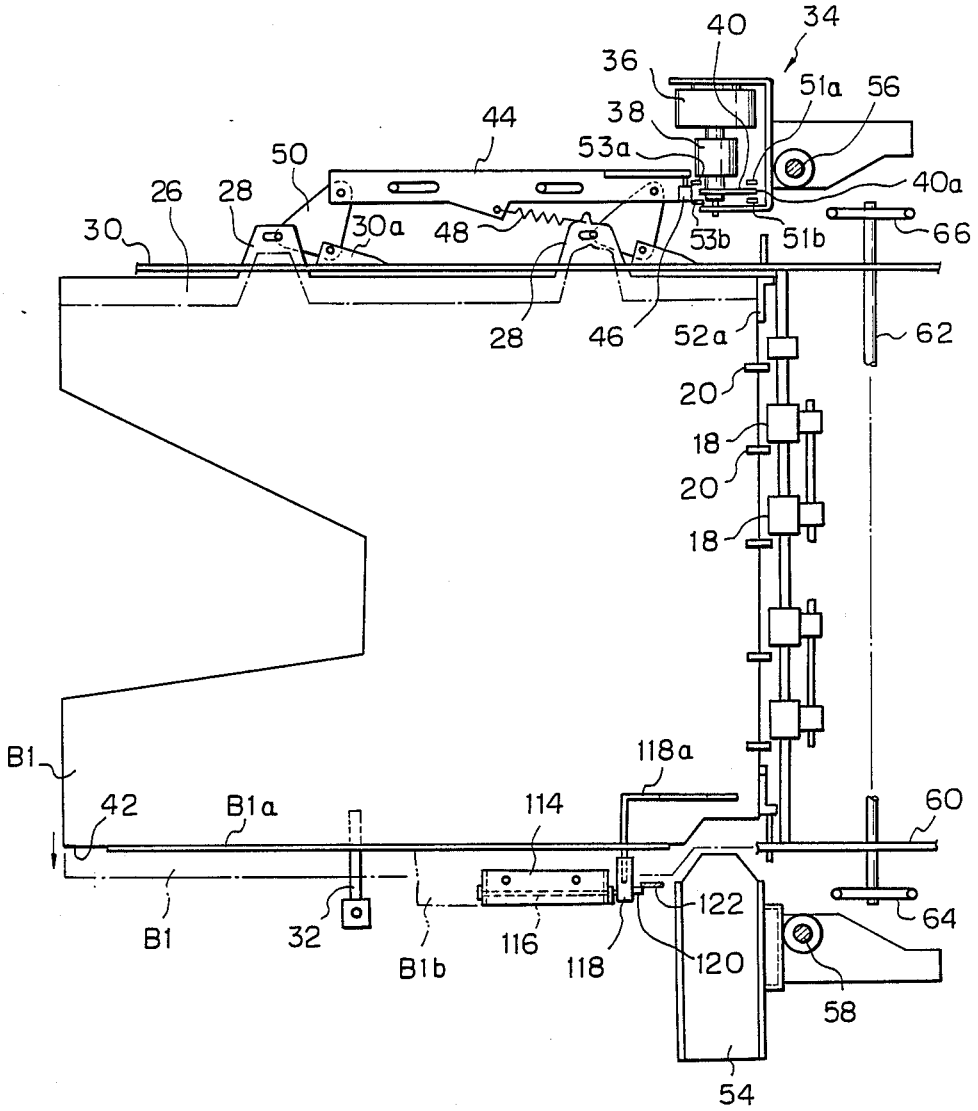
FIG. 8 is a plan view showing another embodiment of the bin and bin drive unit.
Figure 9:
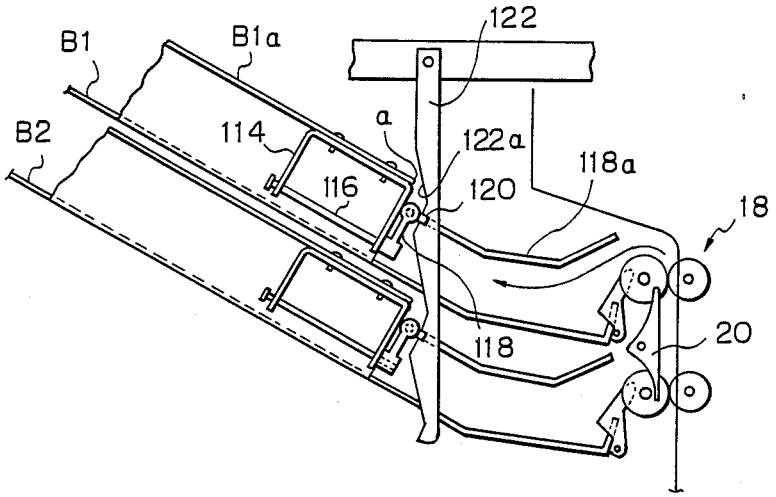
FIG. 9 is a side elevation of the bin as shown in FIG. 8.
Figure 10A:
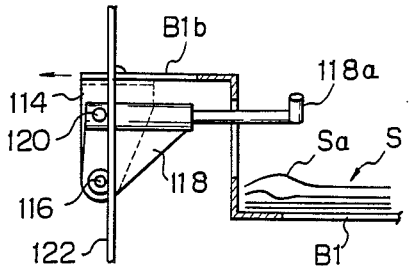
FIGS. 10A and 10B are views representative of operation of a copy pressing member as also shown in FIG. 8.

As shown in FIG. 8, a projection B1*b* extends out from the upper end of the side wall B1*a* of the bin B1 and perpendicularly to the side wall B1*a*. As shown in FIG. 9, a bracket 114 is fastened by screws to the projection B1*b* while a shaft 116 is supported by leg portions of the bracket 114. Fixed to one end of the shaft 116 is the base end of a copy pressing member 118. The pressing member 118 is implemented with a wire-like member which is bent at a right angle and provided with a pressing section 118*a*, which is configured as shown in FIG. 9. A pin 120 is studded on the pressing member 118 and engaged with a locking member 122, FIGS. 10A and 10B, which is unmovable relative to the bin B1. As shown in FIG. 10A, the pressing section 118*a* of the pressing member 118 extends into the bin B1, and the pressing member 118 is provided with such a tendency that the pressing section 118*a* moves toward the copy sheets S which are stacked in the bin B1. In this particular embodiment, such a tendency is implemented with a rotational moment derived from the weight of the pressing member 118 (clockwise moment as viewed in FIGS. 10A and 10B). The locking member 122 with which the pin 120 is engaged serves to usually maintain the pressing section 118*a* of the pressing member 118 spaced by the bin B1.

Figure 10B:
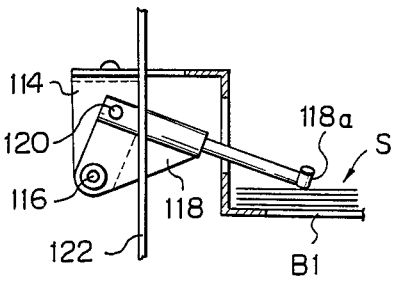

As the bin B1 is moved by the bin drive unit 34 to a position indicated by dash-and-dot lines in FIG. 8, i.e., as the bin B1 is shifted as indicated by an arrow in FIG. 10A, the pressing member 118 is rotated clockwise about the shaft 118 due to its own weight. When the bin B1 reaches the stapling position, the pressing section 118*a* of the pressing member 118 makes contact with that portion of the stack of copy sheets S which is close to the stapling position, i.e., inwardly of the corner portion of the sheet stack S, as shown in FIG. 10B. At this instant, the pin 120 has been released from the locking member 122.

When any of the copy sheets S in the stack has a curl Sa, the pressing section 118*a* of the pressing member 118 removes the curl Sa in contact with the stack, so that the copy sheets S are bound by the stapler 54 with their edges aligned accurately. There is also eliminated an occurrence that the copy sheets S are brought out of alignment while the bin B1 is in movement. After the binding operation has been finished, the bin B1 is moved to the right from the position of FIG. 10B. During this movement of the bin B1, the pin 120 is caused into contact with the stationary locking member 122 and forced relatively thereby, resulting that the pressing member 118 regains the position of FIG. 10A. The procedure described so far is also effected on each of the second bin B2 and onward.

While the contact of the pressing member 118 with the copy sheets S has been shown and described as implemented with gravity, it may alternatively be accomplished by use of a spring in which case the pin 120 would be received by the locking member 118 under the action of the spring.

Further, as shown in FIG. 9, the locking member 122 is provided with a notch 122*a* which allows a portion a of the bin B1 to clear the locking member 122 during the movement of the pin 120.

As also shown in FIG. 9, the pressing section 118*a* of the pressing member 118 is configured to play another role, i.e., guiding a copy sheet which is driven by the delivery roller pair 18 toward the bin B1.

As described above, this embodiment allows a stapler to accurately bind a stack of copy sheets with the edges of the latter neatly aligned, even if any of the copy sheets is curled.

The operation of the sorter in accordance with any of the embodiments shown and described will be explained with reference to FIGS. 11 and 12.

Figure 11:
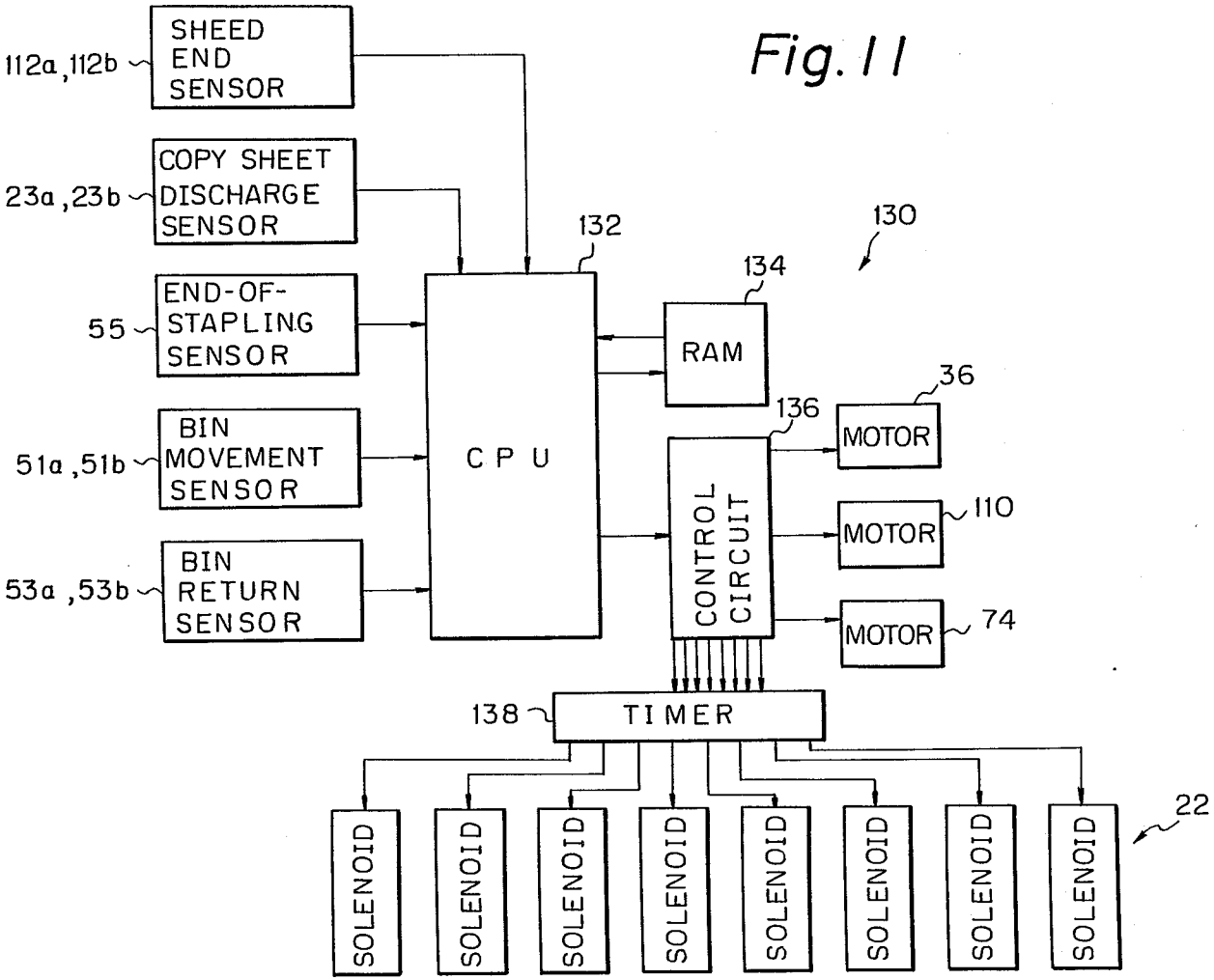
FIG. 11 is a block diagram showing a system in accordance with the present invention.

FIG. 11 is a block diagram showing a controller adapted to control the entire system which includes the sorter, the copier body connected to the sorter, and an automatic document feeder (ADF). The controller, generally 130, includes a central processing unit (CPU) 132 which is built in the copier body and supplied with output signals of the sheet end sensor 112*a*, 112*b* responsive to the delivery of a copy sheet to any of the bins, sensor 23*a*, 23*b* responsive to a copy sheet which is driven out of the copier body, sensor 55 responsive to the end of a stapling operation, sensor 51*a*, 51*b* responsive to the arrival of any of the bins at the prescribed stapling position, and sensor 53*a*, 53*b* responsive to a return of the bin to its initial position after a stapling operation. Connected to the CPU 132 are a random access memory (RAM) 134 adapted to store an output signal of the sensor 112*a*, 112*b* and that of the sensor 23*a*, 23*b* as data, and a control circuit 136 adapted to control the motors 36, 110 and 74 as commanded by the CPU 132. A timer 138 functions to deliver motor control signals from the control circuit 136 to the independent solenoids 22 at predetermined timings. The outputs of the sensors 23*a* and 23*b* are also applied to the timer 138 and, in addition, used to provide copy count data for determining a destination of each copy sheet. The CPU 132, sorter and ADF are held in on-line interconnection to be capable of interchanging information all the time.

Figure 12A:
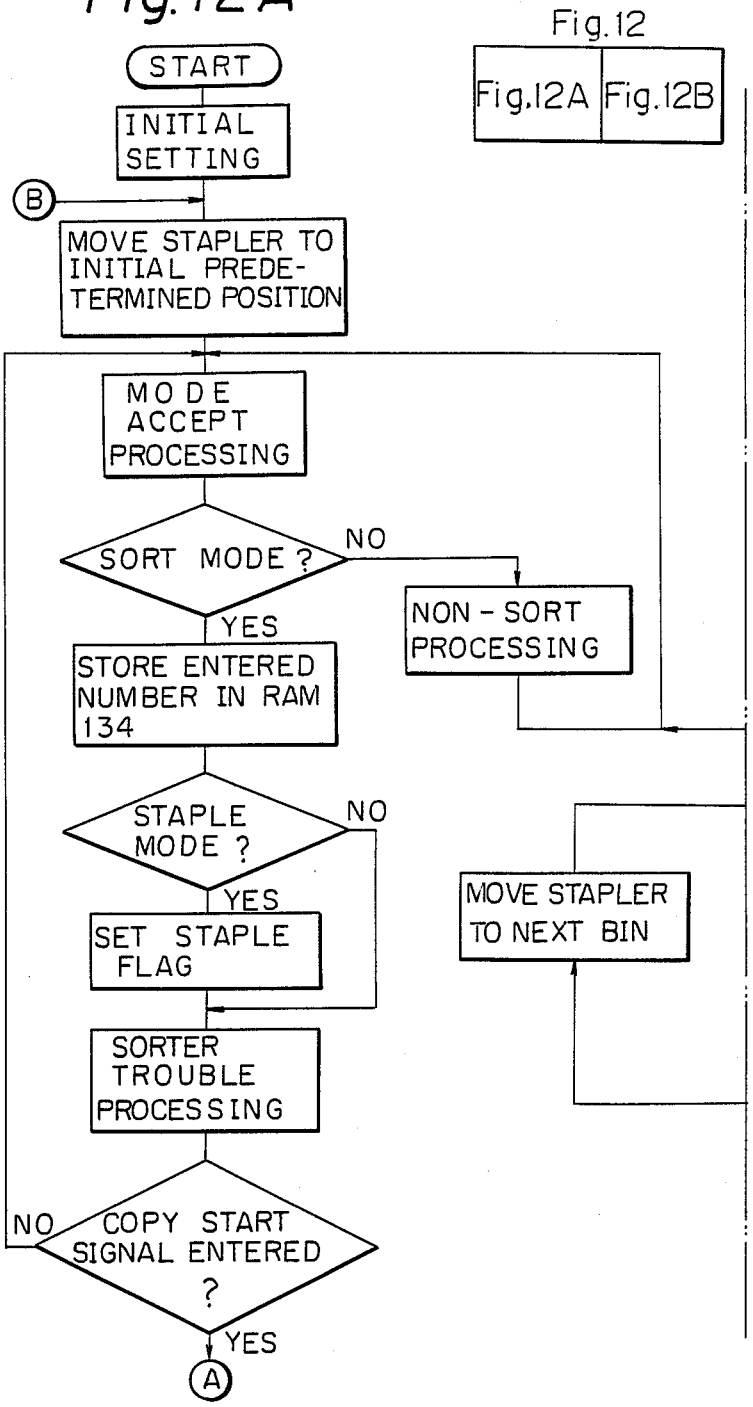
FIGS. 12A–12B are flow charts demonstrating a sequence of steps in accordance with the present invention.
Figure 12B:
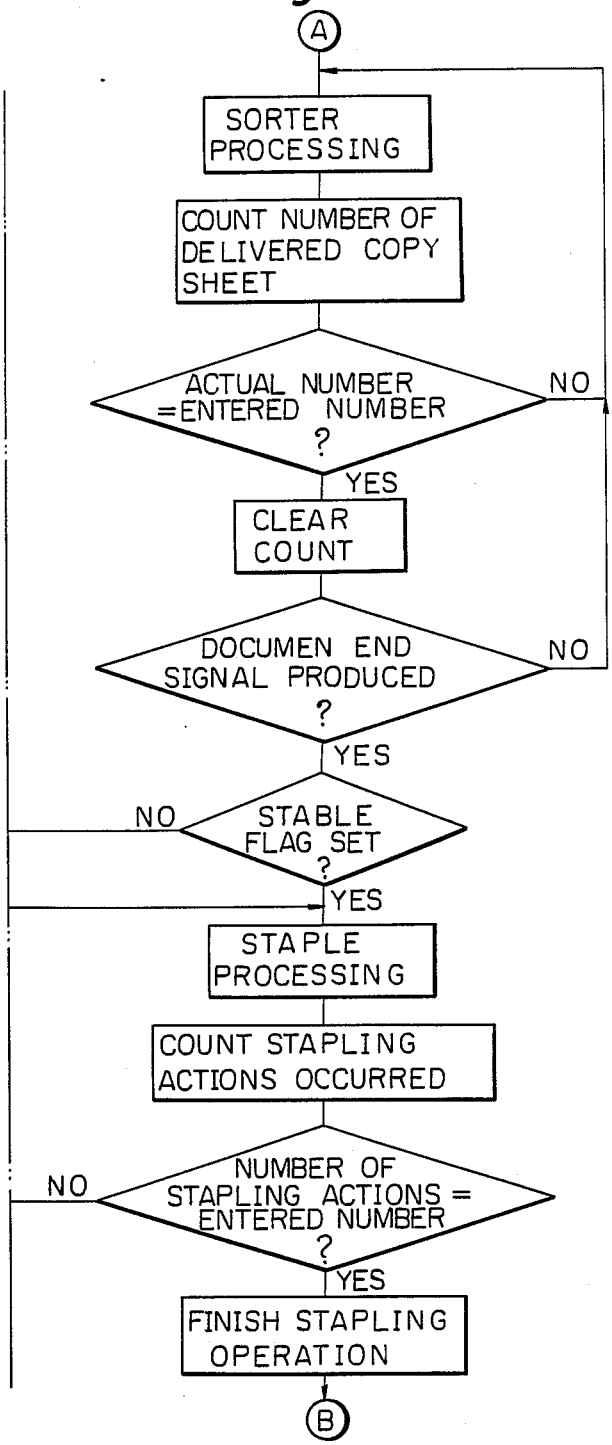

Referring also to FIG. 12, when a power is turned on, electrical initial setting such as allocating different areas of the RAM 134 to different kinds of data is performed and, then, the stapler 54 is moved to the stapling position for the first bin B1. On the other hand, the operator loads the ADF with a desired number of documents and enters a desired number of copies to be produced with each document through buttons of the copier, not shown, the input data being stored in the RAM 134. As the operator selects a staple mode, a staple flag is set in the RAM 134. Subsequently, a copying operation is initiated and the ADF and the sorter are operated, in response to a copy start signal which is entered by the operator.

A copy sheet which is transferred from the copier body to the sorter is sensed by the sensor 23*a*, 23*b* the output of which is stored in a counter of the RAM 134. The output of the sensor 23*a*, 23*b* is also routed to the CPU 132 which then triggers the timer 138 in order to energize the solenoids 22 at predetermined timings. When any of the solenoids 22 which corresponds to the count stored is energized, its associated pawl 20 is moved into the transport path 16 to guide the copy sheet to one of the bins which is associated with the pawl 20. Specifically, if the count is "1", the solenoid 22 which is assigned to the first bin B1 is energized. As soon as the copy sheet is delivered to the bin, the solenoid 22 is deenergized by the resultant output of the sensor 112*a*, 112*b* to restore the pawl 20 to its inoperative position.

By the above procedure, the pawls 20 assigned to the respective bins are sequentially controlled based on the count, so that the second paper and others, too, are distributed to prescribed bins. When the count of copy sheets sensed by the sensor 23*a*, 23*b* becomes equal to the number entered by the operator, the CPU 132 clears the count stored in the counter. On the other hand, the ADF removes the document from a glass platen while feeding the next document to the same. Copy sheets produced with the second document are sequentially delivered to the bins by the same operation as described above.

The sequence of steps stated above are repeated until the documents have been used out. Specifically, a document end sensor, not shown, is provided on a platform of the ADF so as to feed a detect signal to the CPU 132 when documents on the platform are exhausted. In response to the output of the document end sensor, the CPU 132 delivers a command for setting up operative connection between the motor 36 and the ½ rotation clutch 38, when a copy sheet of the final document is distributed to the first bin B1. Specifically, after the detection of the absence of documents on the ADF platform, the CPU 132 determines whether or not a stapling flag is present. If the flag is present, the CPU 132 drives the motor 36 to staple the copy sheets in response to an output of a timer element which is adapted to count a prescribed time triggered by the previously mentioned counter clear signal, which is produced on coincidence of the number of copies produced with a certain document with the entered number. So long as the timer 138 counts a period of time necessary for a copy sheet to be transported from the sensor 23*a*, 23*b* to the first bin B1, the stapler 54 is prevented from binding copy sheets together before all copy sheets are delivered. It is to be noted that the motor 36 is driven responsive to the copy start command.

In FIG. 2, the ½ rotation clutch 38 causes the eccentric cam 40 to rotate by half a rotation so that the large diameter portion of the cam 40 is urged against the cam follower 46, the actuating lever 44 thus being moved to in turn move the bin. As previously mentioned, the cooperative sensor elements 51*a* and 51*b* are located in the vicinity of and at both sides of the cam 40 so as to produce an output when the larger diameter portion of the cam 40 is urged against the cam follower 46 to thereby move the bin toward the stapler 54. The output of the sensor 51*a*, 51*b* is applied to the CPU 132 which then delivers a staple command to the stapler 54. When the stapling operation is completed, the sensor 55 produces a detect output. This detect output is fed to and stored in the RAM 134 as staple count data.

The CPU 132 which is also applied with the staple count data delivers a command for setting up operative connection between the motor 36 and the ½ rotation clutch 38 and, therefore, returning the bin to its original position. The ½ rotation clutch 38 now coupled causes the eccentric cam 40 to rotate until the smaller diameter portion of the cam 40 faces the cam follower 46, whereby the bin is restored to the original position. When the smaller diameter portion of the cam 40 faces the cam follower 46, the cooperative sensor elements 53*a* and 53*b* which are disposed at both sides of the cam 40 produce an output which is also applied to the CPU 132. The CPU 132 compares the "number of stapling actions performed" and the "number of copies produced with each document" and, if they are different from each other, continuously energizes the motor 74 to move the stapler 54 until the position sensor 78 senses the next opening 82.

When the position sensor 78 senses any of the openings 82 which corresponds to one of the bins which requires stapling, the CPU 132 produces a signal for deenergizing the motor 74. At the same time, the stapler 54 is brought into a halt at a prescribed position by suitable braking means, not shown, such as reverse rotation of the motor. The worm gear 76 which is mechanically irreversible serves to prevent the stapler 54 from being moved up and down despite impacts which are involved in the stapling actions.

Thereafter, the stapling operation is repeated on each of the second bin and onward while, every time it is completed on one bin, the "number of stapling actions performed" and the "number of copies produced with each document" are compared. The transport of the stapler 54 and the stapling operation are continued until the two different numbers mentioned above become equal to each other. On coincidence of the two numbers, all the operations are finished with the stapler 54 returned to the first bin to wait for another sorting cycle.

In summary, it will be seen that in accordance with the present invention it is needless for a bin drive unit and a stapler to be installed in each of multiple bins and, hence, a simple and inexpensive sorter is achieved.

Furthermore, the sorter of the present invention is not such that a stapler is brought toward a bin, but such that a bin is brought toward a stapler. This allows a stapler to be fixed in place and, therefore, configured as a cartridge, while allowing the dimensions of a stapler to be increased as desired even though the distance between nearby bins may be relatively short.

Various modifications will become possible for those skilled in the art after receiving the teachings of the present disclosure without departing from the scope thereof.

What is claimed is:

1. A sorter having a function of binding copy sheets, comprising:

a plurality of bins each for stacking copy sheets therein;

a stapler for driving a staple into a predetermined portion of a stack of copy sheets in any of said bins;

bin moving means for moving said bin loaded with a stack of copy sheets toward said stapler so that said predetermined portion of said stack is brought to a predetermined stapling position; and drive transmitting means for moving the stapler and said bin moving means in an interlocked motion to, respectively, a position corresponding to a selected one of the bins and a drive position for driving said selected bin toward said stapler.

2. A sorter as claimed in claim 1, further comprising a shift roller provided in each of the bins to be movable toward and away from the copy sheets which are stacked on said bin, for shifting said copy sheets one by one toward a position of said bin close to the stapler.

3. A sorter as claimed in claim 2, further comprising shift roller driving means for driving said shift roller in interlocked relation to the stapler.

4. A sorter as claimed in claim 1, further comprising copy sheet pressing means provided in each of the bins for pressing a portion of the copy sheets adjacent to said predetermined portion, said copy sheet pressing means having a tendency to move toward said copy sheets.

5. A sorter as claimed in claim 2, further comprising locking means for maintaining said copy sheet pressing means spaced from the bin against said tendency of said copy sheet pressing means.

* * * * *